US010047603B2

(12) United States Patent
Li et al.

(10) Patent No.: US 10,047,603 B2
(45) Date of Patent: Aug. 14, 2018

(54) ANALYZING SUBSURFACE MATERIAL PROPERTIES USING A LASER VIBROMETER

(71) Applicant: Halliburton Energy Services, Inc., Houston, TX (US)

(72) Inventors: Gang Li, Houston, TX (US); Jesse Clay Hampton, Cypress, TX (US); Costas Christofi, League City, TX (US); Syed Muhammad Farrukh Hamza, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 234 days.

(21) Appl. No.: 14/910,224

(22) PCT Filed: Aug. 29, 2013

(86) PCT No.: PCT/US2013/057371

§ 371 (c)(1),
(2) Date: Feb. 4, 2016

(87) PCT Pub. No.: WO2015/030780

PCT Pub. Date: Mar. 5, 2015

(65) Prior Publication Data

US 2016/0177709 A1 Jun. 23, 2016

(51) Int. Cl.

| | |
|---|---|
| ***E21B 49/00*** | (2006.01) |
| ***E21B 47/10*** | (2012.01) |
| ***E21B 28/00*** | (2006.01) |
| ***E21B 43/00*** | (2006.01) |

(52) U.S. Cl.
CPC ..... *E21B 49/00* (2013.01); *E21B 28/00* (2013.01); *E21B 43/003* (2013.01); *E21B 47/101* (2013.01); *E21B 47/102* (2013.01)

(58) Field of Classification Search
CPC ..... E21B 49/00; E21B 43/003; E21B 28/00; E21B 47/101; E21B 47/102; E21B 47/002; E21B 47/09
See application file for complete search history.

(56) References Cited

U.S. PATENT DOCUMENTS

| | | | |
|---|---|---|---|
| 5,095,465 | A | 3/1992 | Stokoe, II |
| 7,719,676 | B2 | 5/2010 | DiFoggio |
| 7,928,861 | B2 | 4/2011 | Camwell et al. |
| 8,528,643 | B2 | 9/2013 | Schultz |
| 2002/0149998 | A1 | 10/2002 | Hoover |

(Continued)

OTHER PUBLICATIONS

"Dynamic Stress and Strain Measurement," Polytec Technical Paper, Published in 2010, 4 pages.

(Continued)

*Primary Examiner* — Brad Harcourt
(74) *Attorney, Agent, or Firm* — Craig Roddy; Parker Justiss, P.C.

(57) ABSTRACT

In some aspects, an acoustic analysis system includes an acoustic source and a laser vibrometer. In some instances, the acoustic source can generate an acoustic signal in a wellbore defined in a subterranean region, and the laser vibrometer can detect movement of a surface in the wellbore in response to the acoustic signal. The detected movement can be analyzed, for example, to identify properties of materials in the subterranean region.

53 Claims, 6 Drawing Sheets

(56) References Cited

U.S. PATENT DOCUMENTS

| | | | | |
|---|---|---|---|---|
| 2004/0252748 | A1 | 12/2004 | Gleitman | |
| 2006/0102343 | A1* | 5/2006 | Skinner | E21B 7/15 166/250.1 |
| 2006/0225509 | A1 | 10/2006 | Haupt et al. | |
| 2007/0056794 | A1* | 3/2007 | Cox | G01V 1/523 181/111 |
| 2008/0166132 | A1* | 7/2008 | Lynde | E21B 29/06 398/142 |
| 2008/0198375 | A1 | 8/2008 | DiFoggio | |
| 2009/0310441 | A1 | 12/2009 | Johnson et al. | |
| 2011/0011576 | A1* | 1/2011 | Cavender | E21B 33/13 166/177.1 |
| 2011/0036575 | A1 | 2/2011 | Cavender et al. | |
| 2011/0122727 | A1 | 5/2011 | Gleitman et al. | |
| 2012/0072128 | A1 | 3/2012 | Gao | |
| 2012/0218119 | A1 | 8/2012 | Cavender et al. | |

OTHER PUBLICATIONS

"Impulse excitation technique," [online] [Retrieved on Jun. 5, 2013] [Retrieved from the Internet <URL: en.wikipedia.org/wiki/Impulse_excitation_technique], Last Modified Mar. 25, 2013, 5 pages.

"Laser-Based Evaluation of Cement Hydration," Polytec Application Note, Published in 2008, 4 pages.

"PSV-400-3D Scanning Vibrometer," Polytec Datasheet, Published in 2009, 8 pages.

"PSV-500-3D Scanning Vibrometer," Polytec Datasheet, Published in 2012, 8 pages.

"Standard Test Method for Dynamic Young's Modulus, Shear Modulus, and Poisson's Ratio by Impulse Excitation of Vibration," ASTM Designation E 1876-09, Jan. 21, 2013, 16 pages.

Gleitman et al., Patent Application No. PCT/US13/33333, filed Mar. 21, 2013, entitled "In-Situ Geo-Mechanical Testing," 60 pages.

PCT International Search Report and Written Opinion of the International Searching Authority, PCT/US2013/057371, dated May 26, 2014, 14 pages.

* cited by examiner

ANALYZING SUBSURFACE MATERIAL PROPERTIES USING A LASER VIBROMETER

This application is a U.S. National Phase Application under 35 U.S.C. § 371 and claims the benefit of priority to PCT Application Serial No. PCT/US2013/057371, filed on Aug. 29, 2013, the contents of which are hereby incorporated by reference.

BACKGROUND

The following description relates to analyzing subsurface material properties using a laser vibrometer, for example, in a wellbore.

Downhole tools can be installed and operated in a wellbore, for instance, during drilling operations, well logging operations, or other well system operations. In some cases, a downhole tool can include sensors or detectors for collecting data from the subterranean formation about the wellbore. For example, subterranean material properties can be measured by wireline logging tools, logging while drilling (LWD) tools or measurement while drilling (MWD) tools.

DETAILED DESCRIPTION

Figure 1A:
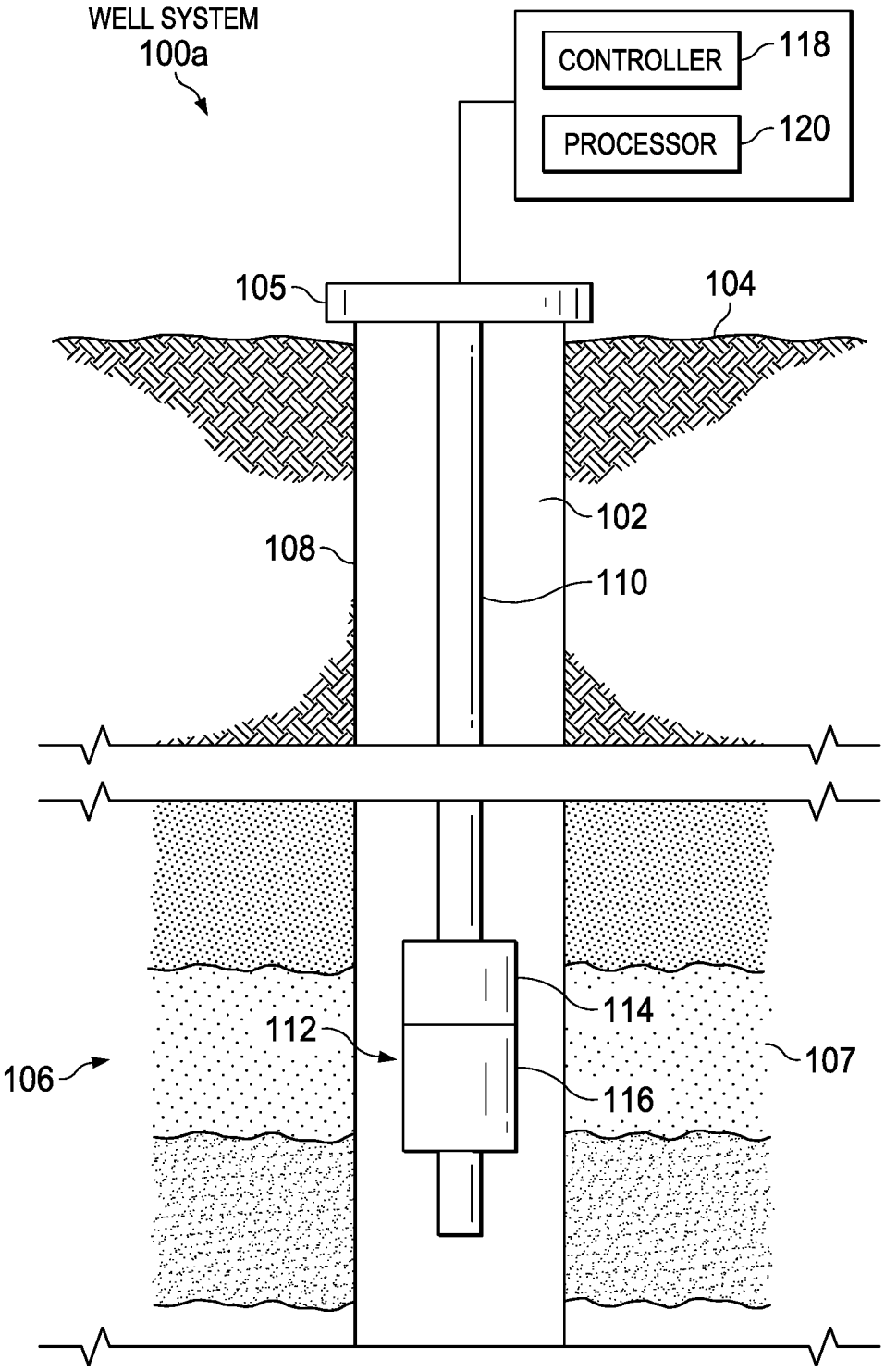
FIG. 1A is a schematic view of an example well system.

In some implementations, an acoustic analysis system includes a laser vibrometer system (e.g., a Laser Doppler Velocimeter (LDV) system) that can measure dynamic movement of a surface (e.g., a surface of subterranean material exposed in a wellbore, a surface of core sample material, etc.). In some instances, the acoustic analysis system can operate downhole, in a wellbore environment. For example, a downhole acoustic analysis tool can include a laser vibrometer system for drilling, wireline logging, or other applications. In some cases, the downhole tool acoustically stimulates the wellbore environment and measures the environment's response. Measurements obtained downhole by the laser vibrometer can be used, for example, to identify material properties of the subterranean environment (e.g., Young's modulus, shear Modulus, Poisson's Ratio, brittleness, or other properties of reservoir rock), to determine the environment's suitability for a formation treatment (e.g., suitability for fracture treatments, stabilization treatments, etc.). In some instances, secondary information derived from LDV measurements or other measurements can be used to partially characterize an environment or formation.

In some cases, a laser vibrometer system can detect movement of a surface without physically contacting the surface, for example, by probing the surface with a laser beam. For instance, in some cases, the laser vibrometer system applies one or more laser beams to a test surface and detects movement of the test surface based on a component of the laser beam reflected by the test surface. In some cases, the laser vibrometer system includes one or more sensors that detect the frequency, phase, intensity, or other properties of the reflected laser beam component. The laser vibrometer system can, in some instances, determine characteristics of the test surface's mechanical movement (e.g., vibrational frequency, vibrational phase, vibrational amplitude, vibrational direction, vibrational mode, etc.).

In some implementations, an acoustic analysis system includes a laser vibrometer and an acoustic source. The acoustic source can stimulate mechanical waves in an environment (e.g., in a subterranean environment, a core sample, etc.), and the laser vibrometer can measure the resulting waves, for example, at an exposed surface of the stimulated environment. The measurements can be used to determine material properties of the environment. In some cases, the acoustic analysis system can be used downhole to collect in situ measurements, in a laboratory to measure samples extracted from the subterranean environment, or in other contexts. In some instances, the acoustic analysis system can be used to analyze rock materials, synthetic cement materials, reconstituted unconsolidated (or weakly consolidated) sands, mudcakes, and other materials downhole or in the laboratory context.

In some cases, the laser vibrometer system can operate without contacting the test surface, which can allow soft or fragile materials to be measured, for example, while preserving the mechanical integrity of the material. In some contexts, repeated measurements can be taken without degrading the material. A laser vibrometer system can, in some cases, produce repeatable, high-precision, non-destructive measurements that can be used, for example, to compare different materials, to compare material properties at different locations, at different times or in different physical environments. Laser vibrometer systems can, in some cases, avoid or reduce mass-loading of the tested or measured article or surface, which can provide advantages, for example, in cases where non-contact, zero-mass-loading is required or otherwise beneficial.

In some instances, using a laser vibrometer system can take advantage of a wide vibration frequency bandwidth, which can be useful for detecting a wide range of dynamic oscillations or vibrations in a subterranean environment. In some cases, a frequency bandwidth up to 1 MHz or higher, including sonic and ultra-sonic phenomena, can be observed. Information derived from the ultrasonic region or other frequency regions can be used to analyze critical components in a subterranean environment.

Laser vibrometer systems can, in some cases, measure characteristics of surface movement that correspond, for example, to different types of physical phenomena or material properties. For example, laser vibrometers can be configured to measure out-of-plane surface movement (i.e., normal to the surface), in-plane surface movement (i.e., shear or parallel to the surface), rotational or angular surface movement, differential movement between distinct locations on a surface, etc. In some cases, a laser vibrometer can scan multiple locations on a surface and identify various types of movement at one or more of the scanned locations (e.g., simultaneously, in a time series, etc.).

In some instances, a downhole acoustic analysis system can provide real-time, in situ, non-destructive analysis of subterranean formation materials. For example, an acoustic analysis system may stimulate the subterranean rock material (e.g., by acoustic signaling, tapping, etc.) to induce surface deflection within a wellbore, and the acoustic analysis system may compute the rock's mechanical properties based on the measured deflection. For example, the acoustic analysis system may include a computing apparatus that can calculate material properties based on measured stresses, strains, frequencies, etc.

FIG. 1A is a schematic diagram of an example well system 100*a* with an example downhole acoustic analysis system 112. The well system 100*a* includes an example wellbore 102 that extends from a well head 105 at the surface 104, through a subterranean region 106 below the surface 104. The subterranean region 106 can include one, less than one, or more than one layers 107, formations, sub-regions, or strata. The wellbore 102 can include straight or curved sections oriented at one or more angles or directions. The wellbore 102 can include one or more vertical, horizontal, or slanted sections, or a combination of them.

The example wellbore 102 shown in FIG. 1A has a wellbore wall 108 that defines a boundary between the wellbore 102 and the subterranean formation surrounding the wellbore 102. Some or all of the wellbore wall 108 can include a casing; some or all of the wellbore wall 108 can be open to the subterranean region (i.e., uncased, or open hole). The wellbore wall 108 can include portions covered with mudcake, drilling fluid, treatment fluid, or other substances.

The example well system 100*a* can include a working string 110 or another type of structure that extends into the wellbore 102. The working string 110 can be continuous or jointed and extend a fixed or variable length into the wellbore 102. In some implementations, the working string can be inserted or retracted within the wellbore 102. The working string 110 can include any suitable conduit or flow apparatus, signaling and control apparatus, or other components. The working string 110 can include drilling components, flow control tools, sensors, or other features.

All or part of the example downhole acoustic analysis system 112 can be coupled to, or may be integral with, the example working string 110 or another type of support structure in the wellbore 102. The acoustic analysis system 112 can be at any position along the length of the working string 110. The example acoustic analysis system 112 includes an acoustic source 114, a laser vibrometer 116, a controller 118, and a processor 120. An acoustic analysis system can include additional or different features or components, and the components of the example acoustic analysis system 112 can be configured as shown in FIG. 1A or in another manner.

The example acoustic source 114 shown in FIG. 1A can produce a mechanical stimulation within the well system 100*a*. Here, the term "acoustic" is used broadly to include all types of mechanical stimulation of a medium or substance, such as vibrations, sound, ultrasound, infrasound, and impulses. The example acoustic source 114 can apply an acoustic stimulation at a known frequency and produce mechanical waves in a stimulated material. In some cases, the acoustic stimulation is applied without a specified or known frequency. In some implementations, the acoustic stimulation can produce compressional waves, shear waves, or any type of mechanical response in the material. The acoustic analysis system 112 can include more than one acoustic source. Multiple acoustic sources can produce mechanical stimulations at the same frequency or at different frequencies, be positioned at the same location or at different locations within the well system, or provide mechanical stimulation to the same or different materials or features.

In some example implementations, the acoustic source 114 includes one or more excitation devices that create an acoustic impulse or a sustained acoustic stimulation in the wellbore 102, one or more tapping devices that mechanically strike the wall of the wellbore 102, or a combination of these and other devices. The acoustic stimulation can have any suitable frequency, amplitude, duration, or other properties. In some examples, the acoustic stimulation can range from several kilohertz to several megahertz. The acoustic stimulation can be applied from within the wellbore 102 (as shown in FIG. 1) or from a distance away from the wellbore 102 (e.g., from within another wellbore, from the surface 104, etc.).

The example laser vibrometer 116 shown in FIG. 1A can use a laser impinging on a surface to detect movement of the surface (e.g., vibrational motion or other types of displacement). The example laser vibrometer 116 can be, for example, a single-point laser vibrometer, a scanning laser vibrometer, a Laser Doppler Velocimeter (LDV), or another type of laser vibrometer. Furthermore, the acoustic analysis system 112 can include multiple laser vibrometers at different locations. In some cases, the acoustic analysis system 112 includes lasers of multiple different types (e.g. gas, semiconductor, dye), multiple different optical wavelengths (e.g. 632 nm, 1064 nm), etc.

The example laser vibrometer 116 can provide advantages in some instances. For example, the laser vibrometer 116 may operate without mechanically contacting the surface being measured, which may allow the laser vibrometer 116 to measure relatively fragile or deformable surfaces without damaging or changing them. As another example, the laser vibrometer 116 may obtain high-precision measurements, for example, detecting surface deflections smaller than 1 nanometer, in some instances. In some cases, laser vibrometers can obtain measurements in a variety of conditions, for example, measuring small surfaces, surfaces of irregular dimensions, surfaces with discontinuities, surfaces with aberrations, surfaces at extreme (e.g., high or low) temperatures or pressures, layered surfaces (e.g., mudcake layering, etc.) or other types of surfaces.

In some implementations, one or more laser vibrometers detects and measures the real-time deflection of the wellbore wall in response to (during, after, or both) an acoustic stimulation by the acoustic source 114. The laser vibrometers may monitor all or part of a circumference of the wellbore wall at one or more depths or locations in the wellbore 102; the laser vibrometers may monitor a longitudinal range or series of depths within a region of interest in the wellbore 102; or the laser vibrometers may monitor the wellbore 102 in another manner. The laser vibrometers can provide measurement conditions, for example, by using a positive pressure sealing device or another type of system to create a known environment in which the laser can be applied to the wellbore wall. The positive pressure sealing device can provide a known fluid (e.g. gas or liquid) in the line of sight of the laser beam (e.g., between the laser source and the test surface), to create a controlled optical environment or to reduce degradation of measurements by formation fluids.

The example controller 118 can control operation of the acoustic source 114, the laser vibrometer 116, or both. The controller 118 can be located downhole in proximity to other components of the acoustic analysis system 112, or it may be located at the surface 104, at another location in the wellbore 102, or at another location outside the wellbore 102. The example controller 118 can initiate, direct, adjust, stop, or otherwise control components of the acoustic analysis system 112. In some cases, the controller 118 can coordinate the timing or positions of the acoustic source 114 and laser vibrometer 116. The example controller 118 may specify the frequency or amplitude of the acoustic source 114. For example, the frequency of the acoustic source 114 can be specified before or during operation.

The example controller 118 can include one or more digital electronic controllers, microprocessors, software, digital or analog circuitry, or other types of hardware. The controller 118 can generate control signals based on instructions received from a local memory, based on an algorithm executed by a local processor, based on control signals from an external source, or a combination of these and other information. For example, the controller 118 can be configured to receive signals or communications from the surface 104, or it may access instructions or data stored locally at the controller 118. In some cases, the controller 118 can operate downhole and receive communication signals from the surface, for example, over fiber optic, wired, wireless, pneumatic, or other communication equipment. The controller 118 may also receive and store data from the laser vibrometer 116 or other components of the acoustic analysis system 112.

The example processor 120 can receive data from the other components of the acoustic analysis system 112 (e.g., the laser vibrometer 116) or external sources and perform analysis on the received data. The analysis can include correlating laser vibrometer measurements to material properties, or other types of analysis. The processor 120 can be located downhole in proximity to the acoustic analysis system 112, or it can be external to the acoustic analysis system 112, such as a separate computing system at the surface 104 or in a remote location. The analysis produced by the processor 120 can be communicated to a user, a memory module, a display, etc. The analysis can be returned to the controller 118, for example, as part of an algorithm or procedure for acoustic testing. The example processor 120 can include one or more digital electronic controllers, microprocessors, software, digital or analog circuitry, or other types of hardware. In some implementations, the controller 118 and the processor 120 are implemented as separate structures, or they may be implemented together in the same processing module, computing system or chip, etc.

The processor 120 can include programs, software, codes, or algorithms operable to analyze laser vibrometer data. In some cases, the analysis is performed in real time during well system operations (e.g., during drilling operations), after well operations have stopped, or both. In some implementations, the processor 120 determines subsurface mechanical properties, for example, by analytical techniques, by numerical modeling, or other techniques. The properties can be determined, for example, based on stresses and strains of the test surface measured by the laser vibrometer 116, based on the frequency of the test surface vibrations, or other information. In some examples, the processor 120 may receive a time-domain measurement signal from the laser vibrometer 116, perform a Fourier transform of the time-domain signal, and analyze the vibrational data in a frequency domain. The processor 120 may extract natural or resonant frequencies from the laser vibrometer data, or perform other types of analyses. In some cases, raw or analyzed data can be compared with anticipated response data of standard materials; the standard materials may include homogenous rock, metals, alloys, cements, synthetic calibration blocks, etc.

In some aspects of operation, some or all of the components of the acoustic analysis system 112 are run into the wellbore 102 on the working string 110. The acoustic analysis system 112 can be positioned, oriented, calibrated, or otherwise prepared for operation in the downhole environment. In operation, the acoustic source 114 can generate acoustic stimulation that propagates in the subterranean region 106, and the laser vibrometer 116 can measure the movement of the wellbore wall 108 or another surface in the wellbore 102 in response to the acoustic stimulation. The processor 120 can analyze data from the laser vibrometer 116, for example, to determine material properties from the laser vibrometer data. In some cases, the processor 120 can provide real-time measurements or other real-time data during drilling operations, logging operations, or other types of operations.

Acoustic analysis operations can be performed in connection with various types of downhole operations at various stages in the lifetime of a well system. The downhole environment in a well system can be rugged and dynamic, for example, including high temperatures and pressures. Many of the structural attributes and components of the surface equipment and acoustic analysis system 112 will depend on the context of the acoustic analysis operations. For example, acoustic analysis may be performed during drilling operations, during wireline logging operations, or in other contexts. As such, the surface equipment and the acoustic analysis system 112 may include, or may operate in connection with drilling equipment, wireline logging equipment, or other equipment for other types of operations.

Figure 1B:
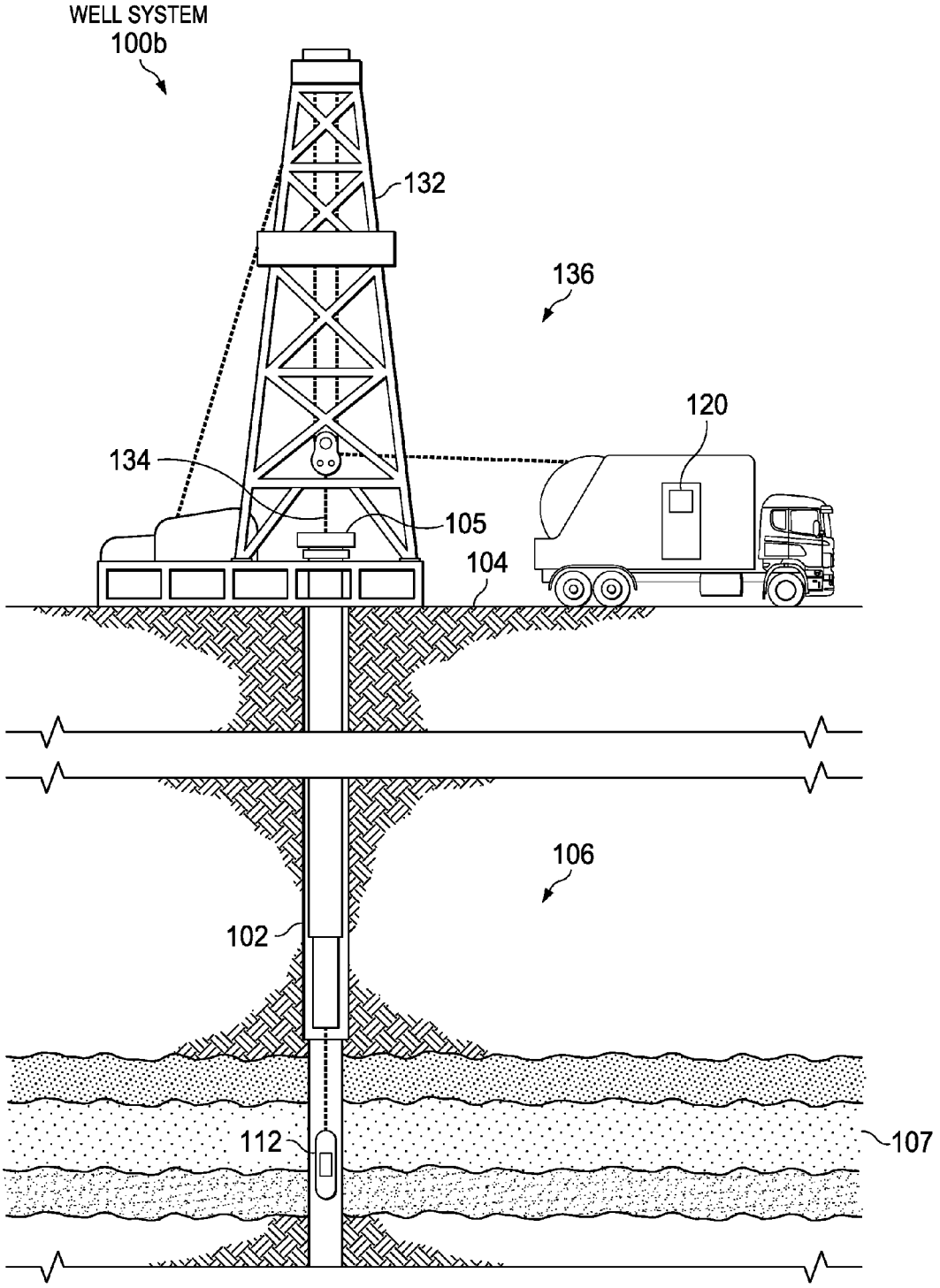
FIG. 1B is a diagram of an example well system that includes an acoustic analysis system in a wireline logging environment.

In some examples, acoustic analysis operations are performed during wireline logging operations. FIG. 1B shows an example well system 100*b* that includes the acoustic analysis system 112 in a wireline logging environment. In some examples, the surface equipment 136 includes a platform above the surface 104, and the platform can be equipped with a derrick 132 that supports a wireline cable 134 that extends into the wellbore 102. Wireline logging operations can be performed, for example, after a drilling string is removed from the wellbore 102, to allow the acoustic analysis system 112 to be lowered by wireline or logging cable into the wellbore 102.

Figure 1C:
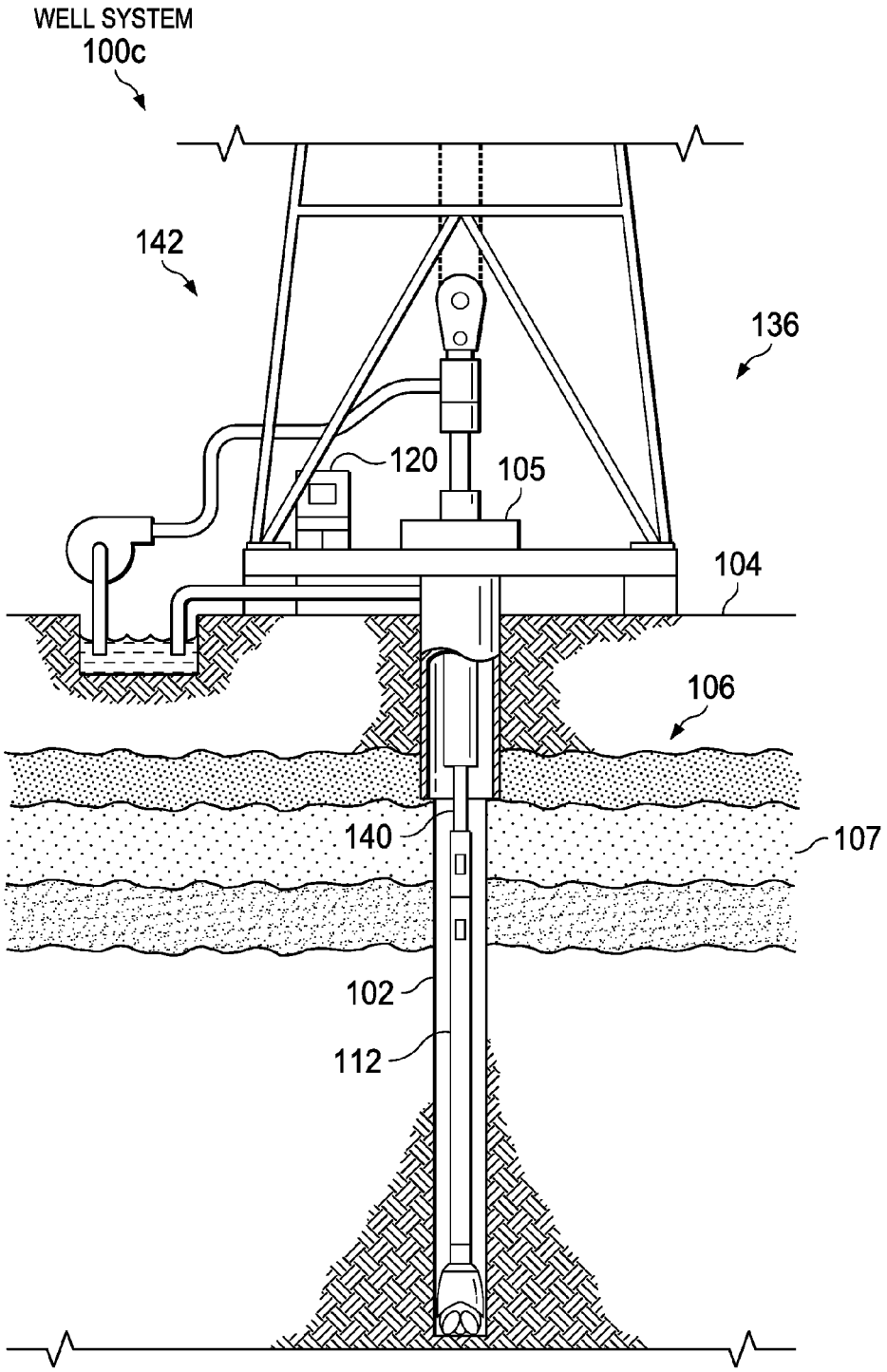
FIG. 1C is a diagram of an example well system that includes an acoustic analysis system in a drilling environment.

In some examples, acoustic analysis operations are performed during drilling operations. FIG. 1C shows an example well system 100*c* that includes the acoustic analysis system 112 in a drilling environment. Drilling is commonly carried out using a string of drill pipes connected together to form a drill string 140 that is lowered through a rotary table into the wellbore 102. In some cases, a drilling rig 142 at the surface 104 supports the drill string 140, as the drill string 140 is operated to drill a wellbore penetrating the subterranean region 106. The drill string may include, for example, a kelly, drill pipe, a bottom hole assembly, and other components. The bottom hole assembly on the drill string may include drill collars, drill bits, the acoustic analysis system 112, and other components.

In some example implementations, the acoustic analysis system 112 operates at multiple locations, orientations, or depths, in the wellbore 102, for example, to obtain measurements from different parts of the subterranean region 106. As shown, for example, in FIG. 1B, the acoustic analysis system 112 can be suspended in the wellbore 102 by a wireline cable, coiled tubing, or another structure that connects the tool to a surface control unit or other components at the surface 104. In some example implementations, the acoustic analysis system 112 is lowered to the bottom of a region of interest and subsequently pulled upward (e.g., in increments) to acquire measurements through the region of interest. As shown, for example, in FIG. 1C, the acoustic analysis system 112 can be deployed in the wellbore 102 on jointed drill pipe, hard wired drill pipe, or other deployment hardware. In some example implementations, the acoustic analysis system 112 collects data during drilling operations while the drill string resides in the region of interest.

Figure 2:
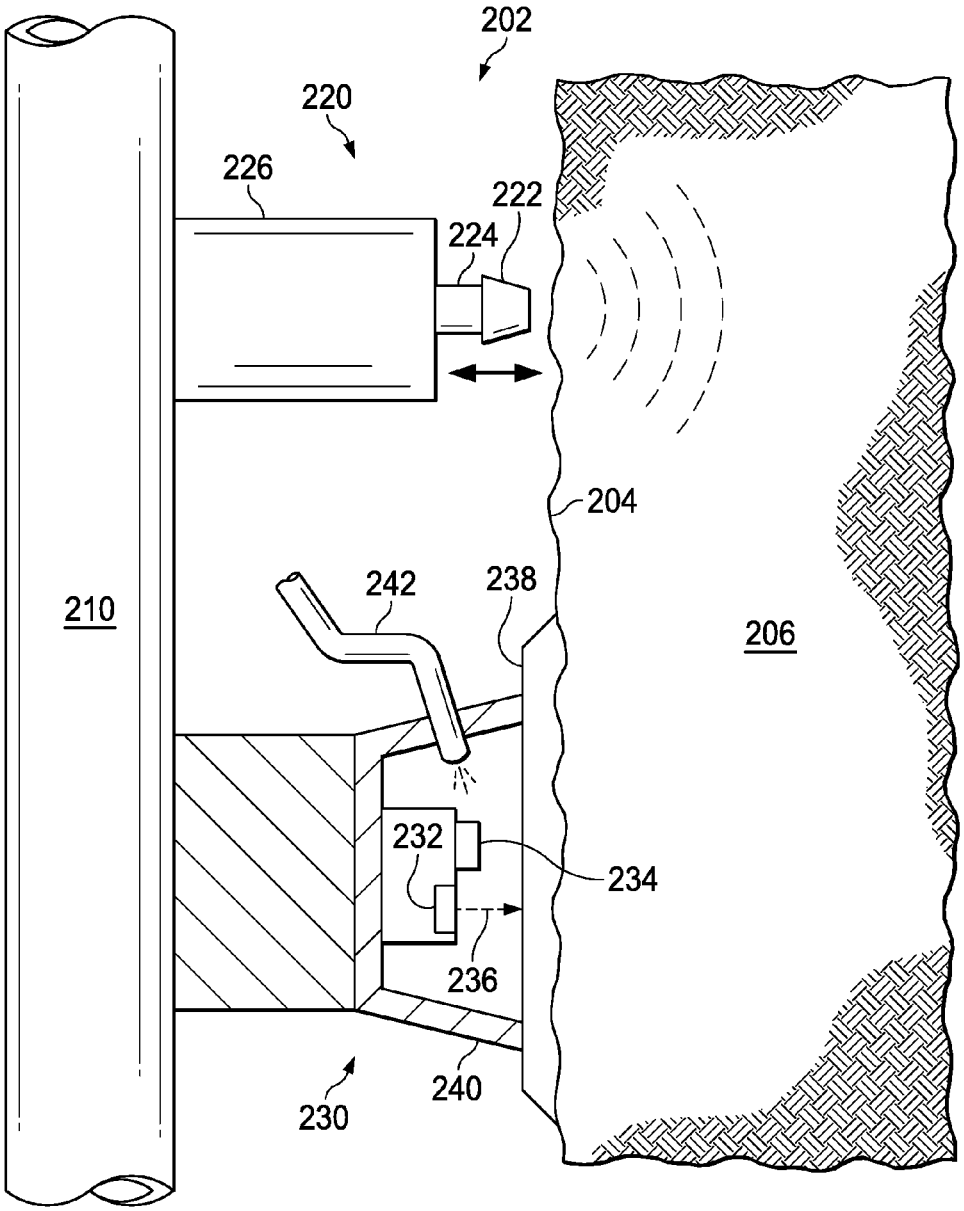
FIG. 2 is a diagram of an example acoustic analysis system.

FIG. 2 is a schematic diagram of an example acoustic analysis system 200 located in a wellbore 202. The example wellbore 202 includes an interior wellbore wall 204. The example wellbore wall 204 can be an exposed reservoir rock surface, a mudcake, or other surface or material. The example acoustic analysis system in FIG. 2 includes an acoustic source 220 and a laser vibrometer 230.

The example acoustic source 220 includes an oscillating hammer 222 coupled to an end of a shaft 224. Actuators within the acoustic source 220 can linearly translate the shaft 224 and the hammer 222 towards and away from the acoustic source base 226. The actuators can be hydraulic, electric, piezoelectric, or use another mechanism or technique to translate oscillating hammer 222 towards or away from the wellbore well. These same, or other, actuators can be used to apply a force through the oscillating hammer 222 such that it bears against the borehole wall. This bearing force may be measured with strain gauges or other force sensors, and may be controlled. These same, or other, actuators can be used to create an oscillating force or displacement against the borehole wall, which may superimpose upon the bearing force against the borehole wall. The acoustic source 220 can oscillate the hammer 222 at a known or specified frequency.

Oscillating hammer 222 may include, or be coupled with, a sensor to detect its displacement versus wellbore wall 204. This sensor may be a displacement sensor such as an LVDT, a potentiometer, an optical displacement sensor, or other means of measuring displacement. Displacement of oscillating hammer 222 may be measured relative to a stationary portion of the system, e.g. the tool body, or a portion of the tool which may be normally in close or intimate contact with the wellbore wall, for example a stabilizer blade. Thus the displacement of the oscillating hammer 222 may be measured precisely as it is moved towards and into contact with the wellbore wall. In some cases, the oscillating hammer 222 may remain motionless or static at times.

The oscillating hammer 222 can impinge the wellbore wall 204 causing mechanical stimulation at the wellbore wall 204, which can produce an acoustic stimulation in the subterranean region 206. The acoustic source 220 can modulate multiple different frequencies, for example, in sequence or concurrently. The amplitude of the oscillations (e.g., the linear distance that the hammer 222 is translated) or the force of the oscillations can be constant or be modulated over time.

In some implementations, the hammer 222 may include a tip to engage the wellbore wall. The tip may be conical or define another type of pointed end. In some cases, the end of the hammer 222 can be hemispherical, or have a flat to engage the formation which may be of circular cross section. In some examples, the end that engages the formation has a diameter of around 1 mm or less, to 1 cm or more. The end of the hammer 222 may have an "x-shape", or other symmetric or asymmetric cross section of similar dimensions, or other cross section. The tip may have a chisel or knife edge which may be aligned along the line of the drill string, or perpendicular to it, or other orientation with respect to the wellbore, the edge being a straight line or arc, and being from 1 cm or less, to 10 or more cm in length. The tip may be made of or coated with carbide, diamond, or a another material of hardness greater than the formation rock.

Oscillating hammer 222 may be translated such that the tip contacts the borehole wall, and it may be actuated to bear against the borehole wall with a known force, and it may be oscillated such that the tip bears against the borehole wall with both "DC" and "AC" forces, akin to an etching or engraving pen commonly known for marking one's property. Here, the "DC" force can represent the force that displaces the hammer into contact with the wellbore wall or other surface, and the "AC" force can be the force that oscillates the hammer about a net displacement. Oscillating hammer 222 may be so applied against the wellbore wall, in a single location, for a defined duration (e.g. number of cycles, or number of seconds), over which duration it may impart impact energy incrementally (cycle by cycle) to the wellbore wall, which may cause material (e.g. rock) failure in linear fashion over the duration, or in a non-linear fashion, the material failure being measured progressively by the incremental displacement of the probe and oscillating hammer 222. In some cases, the duration (number of cycles, or seconds) may be measured to achieve a defined amount of probe displacement (e.g. 1 mm or less, or 1 to several cm). In either approach, a correlation may be determined between the imparting of impact energy to the wellbore wall, and the degree or rate of failure of the wellbore wall, from which local or bulk properties of the wellbore wall (e.g. harness, composition, brittleness, fracturability) may be calculated, inferred, or correlated. In some cases, the hammer 222 and associated measurements of the hammer 22 can be used to measure properties of the subterranean formation independent of the laser vibrometer 230, or the hammer 222 can be used in coordination with the laser vibrometer 230 or other detection systems.

The example acoustic source 220 shown in FIG. 2 is located adjacent to the laser vibrometer 230, but the acoustic source can be located at a distance apart from the laser vibrometer 230. In some implementations, the acoustic source 220 can be located at the surface (exterior to the wellbore) or in a separate wellbore. In some implementations, multiple acoustic sources can be used. The multiple acoustic sources can oscillate at the same frequency or at different frequencies. The multiple acoustic sources can oscillate simultaneously or at different times, sequentially or simultaneously. The sequence, timing, amplitude, or frequency of the oscillations can be preconfigured, directed by an algorithm, or be directed from communication signals.

In FIG. 2, the example acoustic source 220 stimulates the wellbore wall 204. In other implementations, the acoustic source 220 can stimulate a different surface. For example, the acoustic source can be positioned to impinge on the working string 210, a separate tool, a membrane or fluid in the wellbore, or another surface.

The example laser vibrometer 230 in FIG. 2 is coupled to the working string 210 and positioned to measure vibrations on the surface of the wellbore wall 204. Surface vibrations can include translational motion in any direction, rotational motion in any direction, and other types of motion. The example laser vibrometer 230 includes one or more lasers 232 and one or more detectors 234. The lasers 232 can generate a laser beam 236 that is directed at the target (in this example, the wellbore wall 204), and the detector 234 can capture some or all of the reflected laser light. The signal from the detector 234 can be processed, for example, by hardware, software, or a combination of them. For example, a processor may analyze the information received from the detector to determine the movement or displacement of the target surface.

The example laser vibrometer 230 includes a fluid control system that can control the line of sight between the test surface and optical equipment (e.g., the lasers 232, the detectors 234, and possibly other components). In the example shown, the fluid control system includes a vibrometer chamber 240 and a fluid pipe 242; a fluid control system can include additional or different features. In some cases, the wellbore contains fluids or other materials that are not optically transmissive, or are otherwise not conducive to optical measurements in situ. The fluid control system can be configured to control the local environment about the test surface, for example, to provide controlled conditions that are appropriate for obtaining measurements of the wellbore wall or other test surface.

In some implementations, the vibrometer chamber 240 includes one or more movable arms or other structures that can move debris and clear a line of sight for the optical equipment of the laser vibrometer. For example, the vibrometer chamber 240 can include chamber walls that initially reside in contact with each other. In some cases, the chamber walls can contact and seal against the wellbore, and then be moved apart from each other to clear a line of sight between the chamber walls. For example, the chamber walls can be separated from each other by pumping fluid into the vibrometer chamber 240 through the fluid pipe 242.

The vibrometer chamber 240 can maintain optically transmissive fluid in the detection region, for example, in the line of sight between the chamber walls, the wellbore wall and the lasers 232 and detectors 234. For example, the vibrometer chamber 240 can include a shield that provides a fluid seal around the laser vibrometer's measurement line of sight. The shield, chamber walls, or other components of the vibrometer chamber 240 along with the test surface can define the boundaries of a detection region, in which the laser vibrometer detects movement of the test surface.

In some instances, the fluid pipe 242 can communicate a stream of optically transmissive fluid into the chamber 240. The optically transmissive fluid can be used as a hydraulic fluid to initially fill or expand the vibrometer chamber 240, or the optically transmissive fluid can be used to displace less optically transmissive materials, such as working fluid, drilling mud, formation fluids, or entrained particulate, from the trajectory of the lasers 232. Water, certain oils, and mixtures or solutions including water and oil, are among many efficient optically transmissive fluids that can be used in the vibrometer chamber 240 to create conditions that are appropriate for obtaining measurements of the test surface. Example techniques and systems for creating or maintaining an optically transmissive medium in a wellbore environment are described in U.S. Pat. No. 7,490,664 entitled "Drilling, perforating, and formation analysis." Other techniques and systems can be used.

In some implementations, the laser vibrometer 230 includes a surface treatment system that prepares the test surface in the wellbore for measurement by the laser vibrometer 230. In some cases, the surface treatment system applies an optically-reflective paint or other substance to the test surface to be measured. For example, the surface treatment system can operate within the vibrometer chamber 240, outside the vibrometer chamber 240, or both to apply a surface treatment 238. The surface treatment 238 can be applied in any suitable manner, for example, by spraying, stamping, etc. The surface treatment 238 can be applied in any geometry or pattern, for example, to provide one or more reference points, measurement points, or scanning points for measurements by the laser vibrometer 230. The surface treatment can be configured to reflect, absorb, or otherwise interact with certain wavelengths or types of laser beams.

Figure 3:
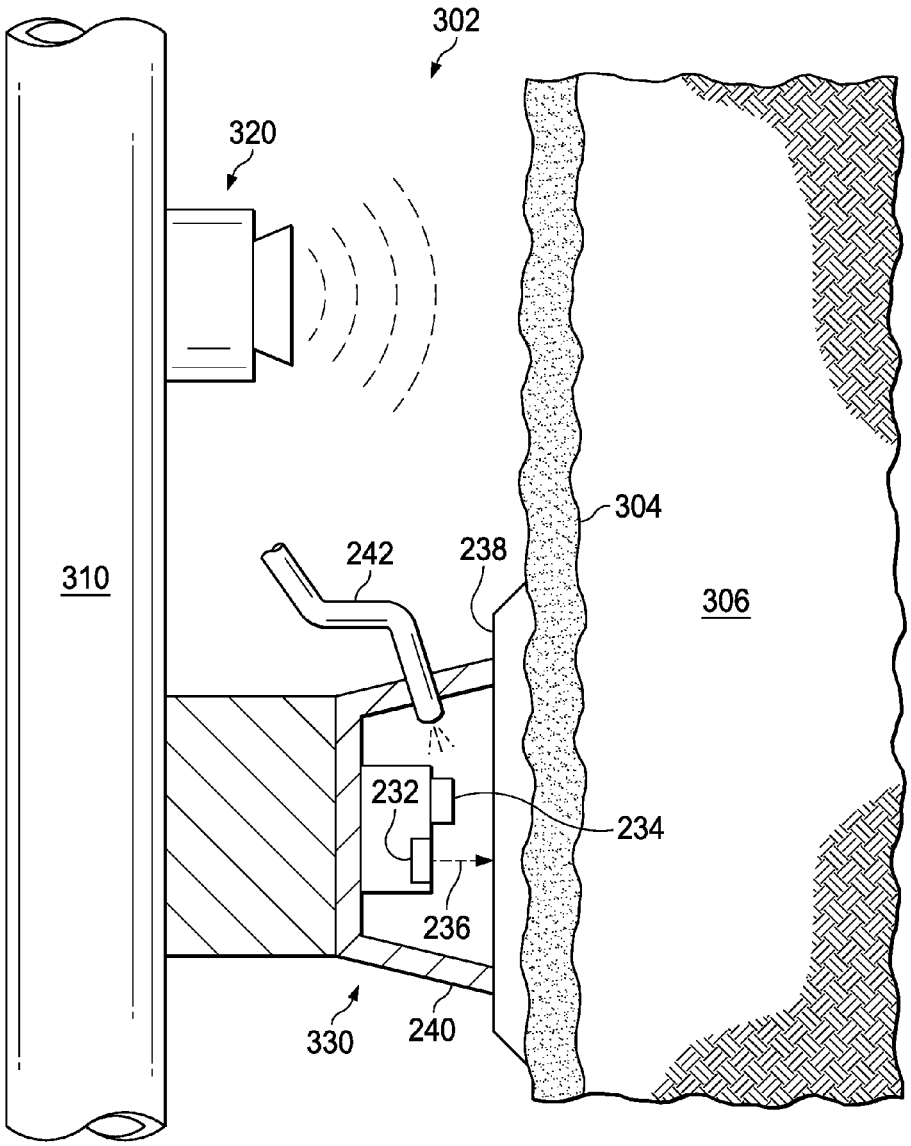
FIG. 3 is a diagram of another example acoustic analysis system.

FIG. 3 shows another example of a downhole acoustic analysis system 300. In FIG. 3, the example acoustic source 320 does not mechanically impinge on the wellbore wall, but is configured to mechanically stimulate a fluid medium within the wellbore 302. The acoustic source 320 can oscillate a diaphragm, emit an acoustic impulse or sustained signal, or otherwise produce an acoustic stimulation in the subterranean region 306. In FIG. 3, the mechanical stimulation introduced into the wellbore 302 stimulates vibrations in a mudcake 304 on the wellbore wall. The laser vibrometer 330 can detect the vibrations, and analysis of the vibration data can determine material properties of the mudcake 304, the reservoir rock in the subterranean region 306, or other materials. The laser vibrometer 330 can be substantially similar to the laser vibrometer 230 shown in FIG. 2.

Figure 4:
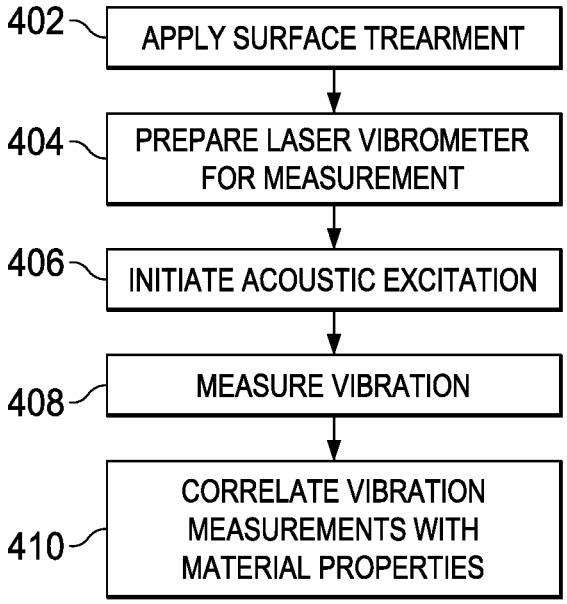
FIG. 4 is a flow chart showing an example technique for detecting vibration in a wellbore.

FIG. 4 is a schematic flow chart of an example process 400 for acoustic analysis. The example process 400 can use all or part of the example acoustic analysis system 112 of FIG. 1A, the example acoustic analysis system 200 shown in FIG. 2, the example acoustic analysis system 300 shown in FIG. 3, or another type of acoustic analysis system. In some implementations, some or all of the example process 400 can be performed in a wellbore to measure subterranean materials in situ, while the subterranean material resides in the subterranean formation or region. In some implementations, the example process 400 can be performed apart from a well system, for example, in a laboratory after the subterranean material has been extracted from the subterranean formation or region. The process 400, individual operations of the process 400, or groups of operations may be iterated or performed in parallel, in series, or in another manner. In some cases, the process 400 may include the same, additional, fewer, or different operations performed in the same or a different order.

At 402, a surface treatment is applied to a target surface. The target surface can be, for example, an exposed reservoir rock surface, a mudcake, a wellbore wall, a surface of a core sample in a laboratory, or another surface or material. The example acoustic analysis system shown in FIG. 2 includes an example surface treatment 238 applied to the wellbore wall 204. The surface treatment 238 can be applied to the target surface (e.g. wellbore wall, mudcake, etc.) before a vibration measurement.

Example surface treatments 238 include coatings or chemicals that can improve operation of the laser vibrometer. For example, a coating can increase the amount of reflected light captured by the detector 234 and thus can improve the signal-to-noise ratio of the detector signal. In some implementations, the coating can be made of reflective epoxy or another material. Some implementations can include applying a pattern (e.g. an array of dots) to the target surface. In some implementations, the laser vibrometer can measure the motion or vibration of the target surface by measuring the movement of the pattern. Multiple different coatings can be applied to the target surface. An application tool can apply the surface treatment, and the application tool can be included in the laser vibration system or it can be a separate tool. In some cases no surface treatment is applied.

At 404, the laser vibrometer is prepared for measurement. This can include positioning the laser vibrometer (e.g., orienting, aligning, translating, etc.), preparing the environment around the laser vibrometer, calibrating the laser vibrometer, or other operations. In an example process to prepare the environment around the laser vibrometer, a control fluid is communicated into a line-of-sight volume adjacent to the laser vibrometer. In some cases, the vibrometer chamber 240 can protect components of the laser vibrometer 230 from debris or turbulence from wellbore fluid. In some implementations, an acoustic source is located within the vibrometer chamber 240 or outside the vibrometer chamber 240.

Furthermore, a control fluid can flow into the vibrometer chamber 240, for example, via the fluid pipe 242. The control fluid can create a controlled optical transmission environment for the laser vibrometer 230 to operate. The control fluid can flush out debris and wellbore fluid from the volume of the vibrometer chamber 240 to create a controlled environment. The control fluid can be water, a chemical mixture, a gas, or another substance. The control fluid can be piped from the surface or from elsewhere in the wellbore 202. For example, the control fluid can be stored in a reservoir within the wellbore or at the surface, and the fluid can be piped into the vibrometer chamber 240 before or during a measurement. The fluid pipe 242 can be coupled to the working string 210 to receive the control fluid, for example, from the reservoir or storage tank. An overpressure of control fluid can be maintained in the vibrometer chamber 240 to keep unwanted debris and wellbore fluid out. The control fluid can be a chemical or chemical mixture with known optical properties. These optical properties (e.g. index of refraction) can be compensated for when aligning or positioning the laser 232 or the detector 234. The control fluid can be selected for compatibility with the optical properties of the surface treatment 238. In a controlled environment with less debris or unwanted material or turbulence, the path of the laser beam 236 can be more accurate and stable, and the detector 234 can potentially capture more reflected light. Thus, a more stable and controlled environment can result in more accurate and less noisy measurements.

In some implementations, the laser vibrometer can identify a laser line-of-sight to the target surface. In the example shown in FIG. 2, the target surface is the wellbore wall 204 (which may have an applied surface treatment 238). For example, in some instances, the position and orientation of the laser vibrometer 230 are known relative to the position and orientation of another known implement, such as the working string 210. In some examples, the surface treatment 238 is more reflective than the bare wellbore wall 204. The laser vibrometer 230 can be rastered, rotated, or otherwise repositioned until the detector 234 detects increased or changed reflected laser light indicative of the surface treatment 238. In some examples, the laser vibrometer 230 can be configured to determine the distance to a surface. The laser vibrometer 230 may translate or rotate until some specified distance is measured, indicating that the laser vibrometer 230 is a certain distance from a target surface. For example, the laser vibrometer 230 may search for the minimum distance to a surface to align with the closest surface (e.g. the adjacent wellbore wall). Other techniques can be used.

At 406, the acoustic source generates mechanical stimulation. With reference to FIG. 2, the example acoustic source 220 can tap on the wellbore wall 204. The acoustic source 220 may tap on the surface treatment 238, the region adjacent to the target surface, or a region some distance away from the target surface. With reference to FIG. 3, the example acoustic source 320 can acoustically stimulate fluid in the wellbore. For example, in some cases, the acoustic stimulation is provided by a whistle, an air gun, or another type of acoustic source in the wellbore. The mechanical waves produced in the wellbore (e.g., from tapping, propagated by fluid in the wellbore, or otherwise) can propagate through material such as rock or mudcake. The mechanical waves can also propagate into the region of the target surface of the laser vibrometer 230.

At 408, the laser vibrometer detects vibration of the target surface. In FIG. 2, the example laser vibrometer 230 detects the movement of the wellbore wall 204. In FIG. 3, the example laser vibrometer 330 detects the movement of the mudcake 304. The mechanical waves produced by the acoustic source 220 at one frequency can cause mechanical waves at a different location (e.g., the wellbore wall 204) at one or more frequencies. The frequency (or frequencies) of the resulting waves may be the same or different than the frequency of the acoustic source. The laser vibrometer 230 can detect the displacement and frequency of these resulting mechanical waves.

In some cases, a signal of interest can be isolated from the laser vibrometer measurement data, for example, by appropriate filtering, signal conditioning, etc. In some implementations, the laser vibrometer can take a vibration measurement before acoustic source activation. A vibration measurement before acoustic source activation can be used, for example, as calibration, a control, etc. For example, background vibration such as that due to machinery can be subtracted or otherwise removed from the vibration measurement.

At 410, the vibration measurement is analyzed, for example, by correlating the vibration measurement with material properties. Analyzing the vibration measurements can include noise reduction techniques such as averaging, filtering, Fourier transformations, or other statistical or processing techniques. Mechanical properties such as Young's modulus, shear modulus, Poisson's ratio, etc. of the target surface region can be calculated from the results. See, for instance, ASTM E 1876, Standard Test Method for Dynamic Young's Modulus, Shear Modulus, and Poisson's Ratio by Impulse Excitation of Vibration. Mechanical properties can also be correlated to material properties, such as rock type, rock composition, material hydration, mudcake thickness, etc. In some cases, the analysis accounts for a known (e.g., controlled or measured) stimulation frequency of the acoustic source.

The mechanical properties can be used to evaluate the region surrounding the target surface. In some instances, the material properties determined from vibration measurements can be used during wellbore operations. For example, material properties or analysis may indicate the presence of mudcake or indicate mudcake thickness. As another example, certain material properties may indicate that a particular subterranean region or stratum is suitable for a certain type of treatment. For instance, analysis of laser vibrometer measurements may indicate that a particular location or region adjacent to the wellbore is the most suitable for application of a fracture treatment, a stabilization treatment, etc.

In some implementations, parameters of a fracture treatment for the subterranean region can be determined from the measured material properties (e.g., Young's Modulus, Poisson's Ratio, etc.) of the subterranean region. For example, the material properties can be used to determine fracturing fluid viscosity, pump rate, proppant concentration, critical breakdown pressure, fracture geometry estimations, or other determinations. In some implementations, a log of raw or analyzed material property data (e.g., Young's Modulus, Poisson's Ratio, etc.) can be plotted versus depth. In some instances, the data log, which can be continuous or discrete points, can be used to calculate or estimate brittleness or ductility of rock formations, which can be used to select intervals of strata most suitable for a stimulation treatment.

In some implementations, some or all of the operations data analysis in the process 400 can be executed in real time, for example, during drilling, logging, or other types of well system operations. An operation can be performed in real time, for example, by performing the operation in response to receiving data (e.g., from a sensor or monitoring system) or as data becomes available, and without substantial delay. An operation can be performed in real time, for example, by performing the operation while monitoring for additional data. Some real time operations can receive an input and produce an output during the well system operations; and in some instances, the output is made available to a user within a time frame that allows an operator to respond to the output, for example, by modifying the well system operations. In some implementations, some or all of the operations and its data analysis can be performed at the same time as one or more other well system operations.

The acoustic analysis system can include other components for downhole use. For example, a cooling system can be incorporated into the laser source. Some types or configurations of lasers operate more efficiently at a specific range of temperatures. The cooling system could include a heat sink, a thermoelectric cooler, a liquid cooler, a circulation system, or another cooling technique. The acoustic analysis system can also include mechanical isolation, for example, to damp or remove external vibrations. For example, the vibration isolation system may be configured to damp unwanted vibration from the working string, the wellbore fluid, another tool, piping, or other source. The vibration isolation system could include hydraulic dampers, spring dampers, or other vibration damping techniques. The vibration isolation may improve the overall signal-to-noise of the vibration measurements. A vibration isolation system could be coupled to the acoustic source, the laser vibrometer, or both.

In some implementations, the acoustic analysis system includes multiple laser vibrometers. The laser vibrometers can be positioned at different locations within and external to the wellbore. For example, multiple laser vibrometers could be positioned downhole radially around the perimeter of the wellbore wall. This example could provide vibrational measurements for the subterranean region entirely surrounding the wellbore at a specific distance into the wellbore. In another example implementation, multiple laser vibrometers could be arrayed over a section of the wellbore wall in order to create a vibrational "map" of an area. Alternately, a single laser vibrometer or a number of laser vibrometers could be rotated or translated within the wellbore between measurements to create a vibrational "map" of an area. If multiple laser vibrometers are used, each laser vibrometer could have an acoustic source associated with it. Alternately, one or more acoustic sources could be associated with all of the vibrometers together. The acoustic source or sources may stimulate a different surface or material than the measured surface or material. These and other configurations and arrangements can be used. In some implementations, single or multiple acoustic excitation sources can provide acoustic excitation at multiple depths in the formation, and the excitation can be detected by one or more detectors to provide a characterization of rock at multiple depths of investigation. The characterization can provide a data log for analysis of the subsurface material.

In some implementations, a core sample of subterranean material can be extracted. The material sample can be removed from the wellbore and brought to the surface to be measured. A laboratory acoustic analysis system may provide a clean, controlled environment in some cases. One or more acoustic sources can be used to stimulate mechanical waves within the core sample. One or more laser vibrometers can be used to measure these resulting mechanical waves, for example, at an exposed surface of the core sample.

A number of examples have been described; various modifications can be made. Accordingly, other implementations are within the scope of the following claims.

The invention claimed is:

1. A downhole system for use in a wellbore in a subterranean region, the downhole system comprising:

an acoustic source operable to generate an acoustic signal in a wellbore defined in a subterranean region; and a laser vibrometer operable within the wellbore to detect movement of a surface in the wellbore in response to the acoustic signal, wherein the laser vibrometer includes:

a chamber having walls that contact and seal against the surface, a laser located in the chamber and configured to direct a laser beam at the surface, a detector located in the chamber and configured to detect some or all of the laser beam reflected off of the surface, and the laser vibrometer includes a surface treatment system operable to apply a surface treatment coating to the surface.

2. The system of claim 1, wherein the surface includes a wall of the wellbore.

3. The system of claim 2, wherein the wall includes reservoir rock.

4. The system of claim 1, wherein the surface includes a mudcake surface on a wall of the wellbore.

5. The system of claim 1, further comprising memory operable to store data collected by the laser vibrometer.

6. The system of claim 5, further comprising data processing apparatus operable to analyze the data.

7. The system of claim 1, wherein the chamber provides a fluid seal around the laser vibrometer's line of sight between the surface and the laser and line of sight between the surface and the detector, the walls of the chamber moveable to clear the line of sight between the surface and the laser and the line of sight between the surface and the detector.

8. The system of claim 1, wherein the laser vibrometer includes a sensor and is operable to control a line-of-sight between the sensor and the surface.

9. The system of claim 1, wherein the laser vibrometer includes a fluid control system operable to communicate a control fluid into a detection region of the laser vibrometer.

10. The system of claim 1, wherein the acoustic source is operable to generate the acoustic signal by contacting a subterranean reservoir medium exposed in the wellbore.

11. The system of claim 1, wherein the acoustic source is operable to generate the acoustic signal by acoustically stimulating fluid in the wellbore.

12. A downhole system for use in a wellbore in a subterranean region, the downhole system comprising:

an acoustic source operable to generate an acoustic signal in a wellbore defined in a subterranean region; and a laser vibrometer operable within the wellbore to detect movement of a surface in the wellbore in response to the acoustic signal, wherein the laser vibrometer includes:

a chamber having walls that contact and seal against the surface, a laser located in the chamber and configured to direct a laser beam at the surface, and a detector located in the chamber and configured to detect some or all of the laser beam reflected off of the surface wherein the chamber provides a fluid seal around the laser vibrometer's line of sight between the surface and the laser and line of sight between the surface and the detector, the walls of the chamber moveable to clear the line of sight between the surface and the laser and the line of sight between the surface and the detector.

13. The system of claim 12, wherein the surface includes a wall of the wellbore.

14. The system of claim 13, wherein the wall includes reservoir rock.

15. The system of claim 12, wherein the surface includes a mudcake surface on a wall of the wellbore.

16. The system of claim 12, further comprising memory operable to store data collected by the laser vibrometer.

17. The system of claim 12, further comprising data processing apparatus operable to analyze the data.

18. The system of claim 12, wherein the laser vibrometer includes a sensor and is operable to control a line-of-sight between the sensor and the surface.

19. The system of claim 12, wherein the laser vibrometer includes a fluid control system operable to communicate a control fluid into a detection region of the laser vibrometer.

20. The system of claim 12, wherein the acoustic source is operable to generate the acoustic signal by contacting a subterranean reservoir medium exposed in the wellbore.

21. The system of claim 12, wherein the acoustic source is operable to generate the acoustic signal by acoustically stimulating fluid in the wellbore.

22. A method comprising:

positioning a laser vibrometer in a wellbore defined in a subterranean region;

operating the laser vibrometer to detect movement of a surface in the wellbore; and analyzing the detected movement, wherein the laser vibrometer includes:

a chamber having walls that contact and seal against the surface, a laser located in the chamber and configured to direct a beam at the surface, a detector located in the chamber and configured to detect some or all of the beam reflected off of the surface, and the laser vibrometer includes a surface treatment system operable to apply a surface treatment coating to the surface.

23. The method of claim 22, comprising detecting the movement while acoustically stimulating the subterranean region.

24. The method of claim 23, wherein the analyzing is based on:

a known frequency of the acoustic stimulation; and a measured frequency of the detected movement.

25. The method of claim 22, wherein the analyzing includes determining a material property of a material in the subterranean region.

26. The method of claim 22, wherein the analyzing includes determining suitability of the subterranean region for application of a treatment.

27. The method of claim 26, wherein the treatment includes a fracture treatment or a stabilization treatment.

28. The method of claim 22, wherein the surface includes reservoir rock.

29. The method of claim 22, wherein the surface includes mudcake material on a wall of the wellbore.

30. The method of claim 22, wherein the chamber provides a fluid seal around the laser vibrometer's line of sight between the surface and the laser and line of sight between the surface and the detector, the walls of the chamber moveable to clear the line of sight between the surface and the laser and the line of sight between the surface and the detector.

31. A method comprising:

acoustically stimulating a subterranean rock medium;

detecting movement of a surface of the subterranean rock medium during the acoustic stimulation, the movement being detected by a laser interaction with the surface; and analyzing the detected movement, wherein the movement being detected is by a laser vibrometer including:

a chamber having walls that contact and seal against the surface, a laser located in the chamber and configured to direct a beam at the surface, a detector located in the chamber and configured to detect some or all of the beam reflected off of the surface, and the laser vibrometer includes a surface treatment system operable to apply a surface treatment coating to the surface.

32. The method of claim 31, wherein acoustically stimulating the subterranean rock medium comprises acoustically stimulating a subterranean region by operation of an acoustic source in a wellbore defined in the subterranean region, and the movement is detected by operating a laser vibrometer in the wellbore.

33. The method of claim 31, comprising detecting the movement of the surface of the subterranean rock medium in situ.

34. The method of claim 31, wherein the analyzing is based on a known frequency of the acoustic stimulation and a measured frequency of the movement.

35. The method of claim 31, wherein the analyzing includes determining a material property of the subterranean rock medium.

36. The method of claim 31, wherein the analyzing includes determining suitability of the subterranean rock medium for application of a treatment.

37. The method of claim 36, wherein the treatment includes a fracture treatment or a stabilization treatment.

38. The method of claim 31, wherein the chamber provides a fluid seal around the laser vibrometer's line of sight between the surface and the laser and line of sight between the surface and the detector, the walls of the chamber moveable to clear the line of sight between the surface and the laser and the line of sight between the surface and the detector.

39. A method comprising:

positioning a laser vibrometer in a wellbore defined in a subterranean region;

operating the laser vibrometer to detect movement of a surface in the wellbore; and analyzing the detected movement, wherein the laser vibrometer includes:

a chamber having walls that contact and seal against the surface, a laser located in the chamber and configured to direct a beam at the surface, a detector located in the chamber and configured to detect some or all of the beam reflected off of the surface, and the chamber provides a fluid seal around the laser vibrometer's line of sight between the surface and the laser and line of sight between the surface and the detector, the walls of the chamber moveable to clear the line of sight between the surface and the laser and the line of sight between the surface and the detector.

40. The method of claim 39, comprising detecting the movement while acoustically stimulating the subterranean region.

41. The method of claim 40, wherein the analyzing is based on:

a known frequency of the acoustic stimulation; and a measured frequency of the detected movement.

42. The method of claim 39, wherein the analyzing includes determining a material property of a material in the subterranean region.

43. The method of claim 39, wherein the analyzing includes determining suitability of the subterranean region for application of a treatment.

44. The method of claim 43, wherein the treatment includes a fracture treatment or a stabilization treatment.

45. The method of claim 39, wherein the surface includes reservoir rock.

46. The method of claim 45, wherein the surface includes mudcake material on a wall of the wellbore.

47. A method comprising:

acoustically stimulating a subterranean rock medium;

detecting movement of a surface of the subterranean rock medium during the acoustic stimulation, the movement being detected by a laser interaction with the surface; and analyzing the detected movement, wherein the movement being detected is by a laser vibrometer including:

a chamber having walls that contact and seal against the surface, a laser located in the chamber and configured to direct a beam at the surface, a detector located in the chamber and configured to detect some or all of the beam reflected off of the surface, and the chamber provides a fluid seal around the laser vibrometer's line of sight between the surface and the laser and line of sight between the surface and the detector, the walls of the chamber moveable to clear the line of sight between the surface and the laser and the line of sight between the surface and the detector.

48. The method of claim 47, wherein acoustically stimulating the subterranean rock medium comprises acoustically stimulating a subterranean region by operation of an acoustic source in a wellbore defined in the subterranean region, and the movement is detected by operating a laser vibrometer in the wellbore.

49. The method of claim 48, comprising detecting the movement of the surface of the subterranean rock medium in situ.

50. The method of claim 47, wherein the analyzing is based on a known frequency of the acoustic stimulation and a measured frequency of the movement.

51. The method of claim 47, wherein the analyzing includes determining a material property of the subterranean rock medium.

52. The method of claim 47, wherein the analyzing includes determining suitability of the subterranean rock medium for application of a treatment.

53. The method of claim 52, wherein the treatment includes a fracture treatment or a stabilization treatment.

* * * * *